US008222507B1

(12) United States Patent
Salazar et al.

(10) Patent No.: US 8,222,507 B1
(45) Date of Patent: Jul. 17, 2012

(54) SYSTEM AND METHOD FOR CAPTURE AND RENDERING OF PERFORMANCE ON SYNTHETIC MUSICAL INSTRUMENT

(75) Inventors: Spencer Salazar, San Francisco, CA (US); Ge Wang, Palo Alto, CA (US); Perry Cook, Applegate, OR (US)

(73) Assignee: Smule, Inc., Palo Alto, CA (US)

( * ) Notice: Subject to any disclaimer, the term of this patent is extended or adjusted under 35 U.S.C. 154(b) by 249 days.

(21) Appl. No.: 12/612,500

(22) Filed: Nov. 4, 2009

(51) Int. Cl.
*G10H 7/00* (2006.01)

(52) U.S. Cl. ..... 84/602

(58) Field of Classification Search ..... 84/602
See application file for complete search history.

(56) References Cited

U.S. PATENT DOCUMENTS

| | | | | |
|---|---|---|---|---|
| 5,288,938 | A * | 2/1994 | Wheaton | 84/600 |
| 5,663,514 | A * | 9/1997 | Usa | 84/600 |
| 7,183,480 | B2 * | 2/2007 | Nishitani et al. | 84/615 |
| 7,394,012 | B2 * | 7/2008 | Schultz | 84/615 |
| 7,723,605 | B2 * | 5/2010 | Gremo et al. | 84/723 |
| 7,781,666 | B2 * | 8/2010 | Nishitani et al. | 84/723 |
| 2003/0159567 | A1 * | 8/2003 | Subotnick | 84/626 |
| 2007/0261540 | A1 * | 11/2007 | Gremo et al. | 84/743 |
| 2008/0047415 | A1 * | 2/2008 | Schultz | 84/723 |
| 2009/0129605 | A1 * | 5/2009 | Camp et al. | 381/77 |
| 2010/0206156 | A1 * | 8/2010 | Scharfeld | 84/604 |
| 2010/0263518 | A1 * | 10/2010 | Nishitani et al. | 84/612 |
| 2010/0288108 | A1 * | 11/2010 | Jung et al. | 84/610 |
| 2011/0210931 | A1 * | 9/2011 | Shai | 345/173 |

OTHER PUBLICATIONS

Wang, Ge "Designing Smule's iPhone Ocarina", NIME09, Jun. 3-6, 2009, 5 pages.

Gaye, L. et al. "Mobile Music Technology: Report on an Emerging Community" In Proceedings of the Conference on New Interfaces for Musical Expression, Jun. 2006, pp. 22-25.

Geiger, G. "Using the Touch Screen as a Controller for Portable Computer Music Instruments" Proceedings of the 2006 International Conference on New Interfaces for Musical Expression (NIME06), Paris France, pp. 61-64.

Rohs, M. et al. "CaMus: Live Music Performance using Camera Phones and Visual Grid Tracking" Proceedings of the 2006 International Conference on New Interfaces for Musical Expression (NIME06), Paris France, pp. 31-36.

(Continued)

*Primary Examiner* — Jeffrey Donels

(74) *Attorney, Agent, or Firm* — Zagorin O'Brien Graham LLP

(57) ABSTRACT

Techniques have been developed for capturing and rendering musical performances on handheld or other portable devices using signal processing techniques suitable given the somewhat limited capabilities of such devices and in ways that facilitate efficient encoding and communication of such captured performances via wireless networks. The developed techniques facilitate the capture, encoding and use of gesture streams for rendering of a musical performance. In some embodiments, a gesture stream encoding facilitates audible rendering of the musical performance locally on the portable device on which the musical performance is captured, typically in real time. In some embodiments, a gesture stream efficiently codes the musical performance for transmission from the portable device on which the musical performance is captured to (or toward) a remote device on which the musical performance is (or can be) rendered. Indeed, is some embodiments, a gesture stream so captured and encoded may be rendered both locally and on remote devices using substantially identical or equivalent instances of a digital synthesis of the musical instrument executing on the local and remote devices.

46 Claims, 8 Drawing Sheets

OTHER PUBLICATIONS

Schiemer, G. and Havryliv, M. "Pocket gamelan: tuneable trajectories for flying sources in Mandala 3 and Mandala 4", in Proceedings of the 2006 Conference on New Interfaces for Musical Expression, Jun. 2006, Paris France, pp. 37-42.
Tanaka, A. "Mobile Music Making" In Proceedings of the 2004 Conference on New Interfaces for Musical Expression, Jun. 2004, pp. 154-156.
Tanaka, A. "A Framework for Spatial Interaction in Locative Media" In Proceedings of the International Conference on New Interfaces for Musical Expression, Jun. 2006, Paris France, pp. 26-30.
Gaye, L. et al. Sonic City: The Urban Environment as a Musical Interface, in Proceedings of the International Conference on New Interfaces for Musical Expression, 2003, Montreal Canada, pp. NIME03-109-115.
Fiebrink, R. et al. "Don't Forget the Laptop: Using Native Input Capabilities for Expressive Musical Control", In Proceedings of the International Conference on New Interfaces for Musical Expression, 2007, New York NY, pp. 164-167.
Wang, G. "The ChucK Audio Programming Language a Strongly-timed and On-the-fly Environ/mentality" A Dissertation presented to the Faculty of Princeton University, Sep. 2008, 192 pages.
Geiger, G. "PDa: Real Time Signal Processing and Sound Generation on Handheld Devices" In Proceedings of the International Computer Music Conference, Barcelona, 2003, pp. 1-4.
P. Cook, "Real Sound Synthesis for Interactive Applications" A.K. Peters, 2005.
G. Essl et al., "Mobile STK for Symbian OS." *In Proceedings of the International Computer Music Conference*, New Orleans, Nov. 2006.
G. Essl et al., "ShaMus—A Sensor-Based Integrated Mobile Phone Instrument." *In Proceedings of the International Computer Music Conference*, Copenhagen, Aug. 2007.
G. Levin, "Dialtones—a telesymphony," http://www.flong.com/projects/telesymphony/, Sep. 2, 2001, Retrieved on Apr. 1, 2007.
G. Wang et al., "MoPhO: Do Mobile Phones Dream of Electric Orchestras?" *In Proceedings of the International Computer Music Conference*, Belfast, Aug. 2008.
A. Misra et al. "Microphone as Sensor in Mobile Phone Performance," *In Proceedings of the International Conference on New Interfaces for Musical Expression*, Genova, Italy 2008.
G. Wang et al., "Stanford Laptop Orchestra (SLORK)," *In Proceedings of the International Computer Music Conference*, Montreal, Aug. 2009.

* cited by examiner

SYSTEM AND METHOD FOR CAPTURE AND RENDERING OF PERFORMANCE ON SYNTHETIC MUSICAL INSTRUMENT

BACKGROUND

1. Field of the Invention

The invention relates generally to musical instruments and, in particular, to techniques suitable for use in portable device hosted implementations of musical instruments for capture and rendering of musical performances.

2. Description of the Related Art

The field of mobile music has been explored in several developing bodies of research. See generally, G. Wang, *Designing Smule's iPhone Ocarina*, presented at the 2009 on *New Interfaces for Musical Expression*, Pittsburgh (June 2009) and published at https://ccrma.stanford.edu/~ge/publish/ocarina-nime2009.pdf. One application of this research has been the Mobile Phone Orchestra (MoPhO), which was established in 2007 at Stanford University's Center for Computer Research in Music and Acoustics and which performed its debut concert in January 2008. The MoPhO employs more than a dozen players and mobile phones which serve as a compositional and performance platform for an expanding and dedicated repertoire. Although certainly not the first use of mobile phones for artistic expression, the MoPhO has been an interesting technological and artistic testbed for electronic music composition and performance. See generally, G. Wang, G. Essl and H. Penttinen, *MoPhO: Do Mobile Phones Dream of Electric Orchestras*? in *Proceedings of the International Computer Music Conference*, Belfast (August 2008).

Mobile phones are growing in sheer number and computational power. Hyper-ubiquitous and deeply entrenched in the lifestyles of people around the world, they transcend nearly every cultural and economic barrier. Computationally, the mobile phones of today offer speed and storage capabilities comparable to desktop computers from less than ten years ago, rendering them surprisingly suitable for real-time sound synthesis and other musical applications. Like traditional acoustic instruments, the mobile phones are intimate sound producing devices. By comparison to most instruments, they are somewhat limited in acoustic bandwidth and power. However, mobile phones have the advantages of ubiquity, strength in numbers, and ultramobility, making it feasible to hold jam sessions, rehearsals, and even performance almost anywhere, anytime.

Research to practically exploit such devices has been ongoing for some time. For example, a touch-screen based interaction paradigm with integrated musical synthesis on a Linux-enabled portable device such as an iPag™ personal digital assistant (PDA) was described by Geiger. See G. Geiger, *PDa: Real Time Signal Processing and Sound Generation on Handheld Devices*, in *Proceedings of the International Computer Music Conference*, Singapore (2003); G. Geiger, *Using the Touch Screen as a Controller for Portable Computer Music Instruments* in *Proceedings of the International Conference on New Interfaces for Musical Expression*, Paris (2006). Likewise, an accelerometer based custom-made augmented PDA capable of controlling streaming audio was described by Tanaka. See A. Tanaka, *Mobile Music Making*, in *Proceedings of the* 2004 *Conference on New Interfaces for Musical Expression*, pages 154-156 (2004).

Indeed, use of mobile phones for sound synthesis and live performance was pioneered by Schiemer in his Pocket Gamelan instrument, see generally, G. Schiemer and M. Havryliv, *Pocket Gamelan: Tuneable Trajectories for Flying Sources in Mandala* 3 *and Mandala* 4, in *Proceedings of the* 2006 *Conference on New Interfaces for Musical Expression*, pages 37-42, Paris, France (2006), and remains a topic of research. The MobileSTK port of Cook and Scavone's Synthesis Toolkit (STK) to Symbian OS, see G. Essl and M. Rohs, *Mobile STK for Symbian OS*, in *Proceedings of the International Computer Music Conference*, New Orleans (2006), was perhaps the first full parametric synthesis environment suitable for use on mobile phones. Mobile STK was used in combination with accelerometer and magnetometer data in ShaMus to allow purely on-the-phone performance without any laptop. See G. Essl and M. Rohs, *ShaMus—A Sensor-Based Integrated Mobile Phone Instrument*, in *Proceedings of the International Computer Music Conference*, Copenhagen (2007).

As researchers seek to transition their innovations to commercial applications deployable to modern handheld devices such as the iPhone® mobile digital device (available from Apple Inc.) and other platforms operable within the real-world constraints imposed by processor, memory and other limited computational resources thereof and/or within communications bandwidth and transmission latency constraints typical of wireless networks, practical challenges present.

Improved techniques and solutions are desired.

SUMMARY

It has been discovered that, despite practical limitations imposed by mobile device platforms and applications, truly captivating musical instruments may be synthesized in ways that allow musically expressive performances to be captured and rendered in real-time. In some cases, the synthetic musical instruments can transform the otherwise mundane mobile devices into social instruments that facilitate performances in co-located ensembles of human performers and/or at distances that foster a unique sense of global connectivity.

Accordingly, techniques have been developed for capturing and rendering musical performances on handheld or other portable devices using signal processing techniques suitable given the somewhat limited capabilities of such devices and in ways that facilitate efficient encoding and communication of such captured performances via wireless networks. The developed techniques facilitate the capture, encoding and use of gesture streams for rendering of a musical performance. In some embodiments, a gesture stream encoding facilitates audible rendering of the musical performance locally on the portable device on which the musical performance is captured, typically in real time. In some embodiments, a gesture stream efficiently codes the musical performance for transmission from the portable device on which the musical performance is captured to (or toward) a remote device on which the musical performance is (or can be) rendered. Indeed, is some embodiments, a gesture stream so captured and encoded may be rendered both locally and on remote devices using substantially identical or equivalent instances of a digital synthesis of the musical instrument executing on the local and remote devices.

In general, rendering includes synthesis of tones, overtones, harmonics, perturbations and amplitudes and other performance characteristics based on the captured (and often transmitted) gesture stream. In some cases, rendering of the performance includes audible rendering by converting to acoustic energy a signal synthesized from the gesture stream encoding (e.g., by driving a speaker). In some cases, the audible rendering is on the very device on which the musical performance is captured. In some cases, the gesture stream encoding is conveyed to a remote device whereupon audible rendering converts a synthesized signal to acoustic energy.

Often, both the device on which a performance is captured and that on which the corresponding gesture stream encoding is rendered are portable, even handheld devices, such as mobile phones, personal digital assistants, smart phones, media players, book readers, laptop or notebook computers or netbooks. In some cases, rendering is to a conventional audio encoding such as AAC, MP3, etc. Typically (though not necessarily), rendering to an audio encoding format is performed on a computational system with substantial processing and storage facilities, such as a server on which appropriate CODECs may operate and from which content may thereafter be served. Often, the same gesture stream encoding of a performance may (i) support local audible rendering on the capture device, (ii) be transmitted for audible rendering on one or more remote devices that execute a digital synthesis of the musical instrument and/or (iii) be rendering to an audio encoding format to support conventional streaming or download.

In some embodiments in accordance with the present invention(s), a method includes using a portable computing device as a musical instrument, the portable computing device having a multi-sensor user-machine interface. The method includes capturing user gestures from data sampled from plural of the multiple sensors, encoding a gesture stream for a performance of the user by parameterizing at least a subset of events captured from the plural sensors, and audibly rendering the performance on the portable computing device. The user gestures are indicative of user manipulation of controls of the musical instrument and the audible rendering of the performance uses the encoded gesture stream as an input to a digital synthesis of the musical instrument executing on the portable computing device.

In some embodiments, the portable computing device includes a communications interface and the method further includes transmitting the encoded gesture stream via the communications interface for rendering of the performance on a remote device. In some embodiments, the encoded gesture stream effectively compresses the sampled data by substantially eliminating duplicative states maintained across multiple samples of user manipulation state and instead coding performance time elapsed between events of the parameterized subset.

In some embodiments, the musical instrument is a synthetic wind instrument and the multi-sensor user-machine interface includes a microphone and a multi-touch sensitive display. In some embodiments, capturing includes recognizing sampled data indicative of the user blowing on the microphone. In some embodiments, such recognition includes conditioning input data sampled from the microphone using an envelope follower, and gesture stream encoding includes recording output of the envelope follower at each parameterized event. In some embodiments, implementation of the envelope follower includes a low pass filter and a power measure corresponding to output of the low pass filter quantized for the inclusion in the gesture stream encoding. In some embodiments, the audible rendering includes further conditioning output of the envelope follower to temporally smooth a T-sampled envelope for the digitally synthesized musical instrument, wherein T is substantially smaller than elapsed time between the events captured and parameterized in the encoded gesture stream.

In some embodiments, capturing includes recognizing at least transient presence of one or more fingers at respective display positions corresponding to a hole or valve of the synthetic wind instrument. At least some of the parameterized events may encode respective pitch in correspondence with the recognized presence of one or more fingers. In some embodiments, the synthetic wind instrument is a flute-type wind instrument.

In some embodiments, the capturing includes recognizing at least transient presence of a finger along a range of positions corresponding to slide position of the synthetic wind instrument. At least some of the parameterized events may encode respective pitch interpolated in correspondence with recognized position. In some embodiments, the synthetic wind instrument is a trombone-type wind instrument.

In some embodiments, the multi-sensor user-machine interface includes an accelerometer and, relative to the accelerometer, the capturing includes recognizing movement-type user gestures indicative of one or more of vibrato and timbre for the rendered performance.

In some embodiments, a synthetic musical instrument includes a portable computing device having a multi-sensor user-machine interface and machine readable code executable on the portable computing device to implement the synthetic musical instrument. The machine readable code includes instructions executable to capture user gestures from data sampled from plural of the multiple sensors, wherein the user gestures are indicative of user manipulation of controls of the musical instrument, and further executable to encode a gesture stream for a performance of the user by parameterizing at least a subset of events captured from the plural sensors. The machine readable code is further executable to audibly render the performance on the portable computing device using the encoded gesture stream as an input to a digital synthesis of the musical instrument.

In some embodiments, a computer program product is encoded in media and includes instructions executable to implement a synthetic musical instrument on a portable computing device having a multi-sensor user-machine interface. The computer program product encodes and includes instructions executable to capture user gestures from data sampled from plural of the multiple sensors, wherein the user gestures are indicative of user manipulation of controls of the musical instrument, and further executable to encode a gesture stream for a performance of the user by parameterizing at least a subset of events captured from the plural sensors. The computer program product encodes and includes further instructions executable to audibly render the performance on the portable computing device using the encoded gesture stream as an input to a digital synthesis of the musical instrument.

These and other embodiments in accordance with the present invention(s) will be understood with reference to the description and appended claims which follow.

BRIEF DESCRIPTION OF THE DRAWINGS

The present invention is illustrated by way of example and not limitation with reference to the accompanying figures, in which like references generally indicate similar elements or features.

FIG. 1 depicts an individual performance use and FIG. 2 depicts performances as an ensemble.

Figure 1:
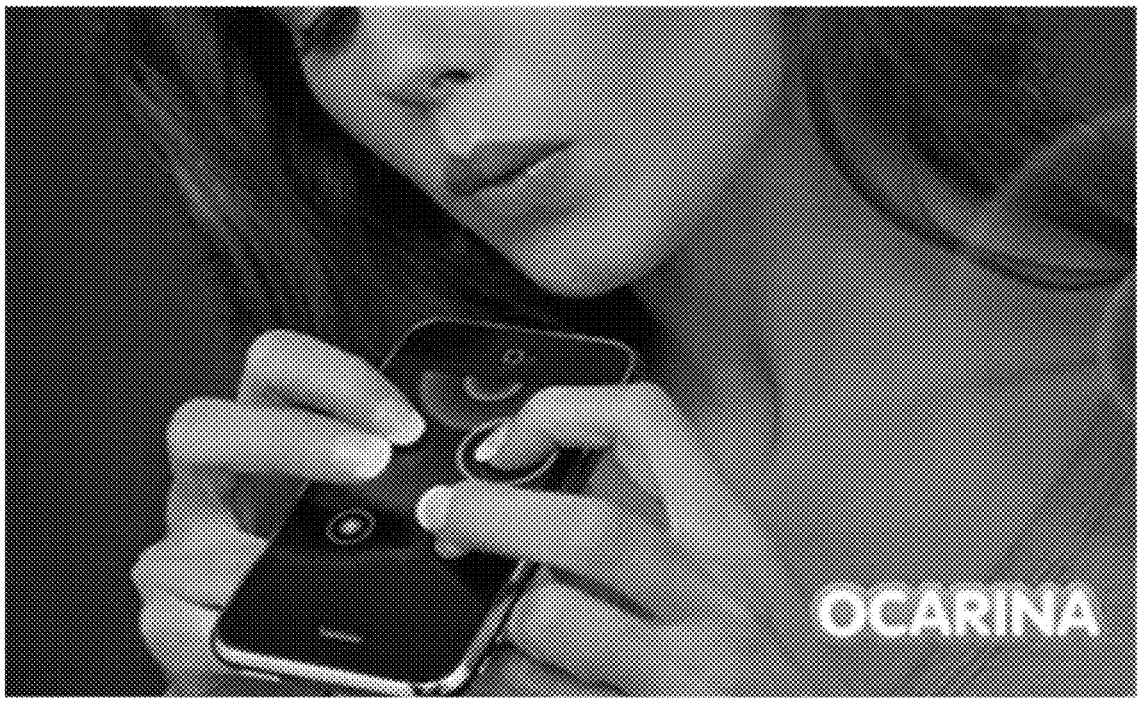
FIGS. 1 and 2 depict performance uses of a portable device hosted implementation of a wind instrument in accordance with some embodiments of the present invention.

Skilled artisans will appreciate that elements or features in the figures are illustrated for simplicity and clarity and have not necessarily been drawn to scale. For example, the dimensions or prominence of some of the illustrated elements or features may be exaggerated relative to other elements or features in an effort to help to improve understanding of embodiments of the present invention.

DETAILED DESCRIPTION

Techniques have been developed to facilitate the capture, encoding and rendering of musical performances on handheld or other portable devices using signal processing techniques suitable given the capabilities of such devices and in ways that facilitate efficient encoding and communication of such captured performances via wireless (or other limited bandwidth) networks. In particular, the developed techniques build upon capture, encoding and use of gesture streams for rendering of a musical performance. In comparison with conventional audio encoding formats such as AAC or MP3, gesture stream encodings can provide dramatic improvements in coding efficiency so long as facilities exist to eventually render the performance (either audibly or to a more conventional audio encoding format such as AAC or MP3) based on the gesture stream encoding itself. For example, for a given performance, gesture stream encodings in accord with some embodiments of the present invention may achieve suitable fidelity at bit rates of 300 Bytes/s, whereas actual audio sampling of the performance can imply bit rates of 32000 Bytes/s and AAC files rendered for the same performance may require 7500 Bytes/s. Accordingly, effective compressions of 25:1 to 100:1 may achieved when audio encodings are used as the baseline for comparison.

Given the foregoing, transfer of a gesture stream encoding of a musical performance (e.g., over limited bandwidth wireless networks) for remote rendering can be preferable to transfer of a conventional audio encoding synthesized from the performance. In some cases, new forms of interaction and/or content delivery, even amongst geographically dispersed performers and devices may be facilitated based on the compact representation.

As used herein, MP3 refers generally to MPEG-1 Audio Layer 3, a digital audio encoding format using a form of lossy data compression, which is a common audio format for consumer audio storage, as well as a de facto standard of digital audio compression for the transfer and playback of music on digital audio players. AAC refers generally to Advanced Audio Coding which is a standardized, lossy compression and encoding scheme for digital audio, which has been designed to be the successor of the MP3 format and generally achieves better sound quality than MP3 at similar bit rates.

Building on the foregoing, systems have been developed in which capture and encoding of gesture streams may be accomplished at the handheld or portable device on which a synthesis of the musical instrument is hosted. A multi-sensor user machine interface (including e.g., a touch screen, microphone, multi-axis accelerometer, proximity sensor type devices and related application programming interfaces, APIs) allows definition of user controls of the musical instrument and capture of events that correspond to the user's performance gestures. Techniques described herein facilitate efficient sampling of user manipulations of the musical instrument and encodings of captured events in the gesture streams. In some embodiments, a gesture stream encoding facilitates audible rendering of the musical performance locally on the portable device on which the musical performance is captured, e.g., in real time. For example, in some embodiments, the gesture stream encoding may be supplied as an input to a digital acoustic model of the musical instrument executing on a mobile phone and the output thereof may be coupled to an audio transducer such as the mobile phone's speaker.

In some embodiments, a gesture stream efficiently codes the musical performance for transmission from the portable device on which the musical performance is captured to (or toward) a remote device on which the musical performance is (or can be) rendered. As previously explained, efficient coding of the musical performance as a gesture stream can facilitate new forms of interaction and/or content delivery amongst performers or devices. For example, gesture stream encodings can facilitate low latency delivery of user performances to handheld devices such as mobile phones even over low bandwidth wireless networks (e.g., EDGE) or somewhat higher bandwidth 3G (or better) wireless networks suffering from congestion. In some embodiments, a gesture stream captured and encoded as described herein may be rendered both locally and on remote devices using substantially identical or equivalent instances of a digital acoustic model of the musical instrument executing on the local and remote devices, respectively.

As used herein, EDGE or Enhanced Data rates for GSM Evolution is a digital mobile phone technology that allows improved data transmission rates, as an extension on top of standard GSM (Global System for Mobile communications). 3G or 3rd Generation is a family of standards for mobile telecommunications defined by the International Telecommunication Union. 3G services include wide-area wireless voice telephone, video calls, and wireless data, all in a mobile environment. Precise definitions of network standards and capabilities are not critical. Rather, persons of ordinary skill in the art will appreciate benefits of gesture stream encoding efficiencies in the general context of wireless network bandwidth and latencies. For avoidance of doubt, nothing herein should be interpreted as requiring transmission of gesture stream encodings over any particular network or technology.

As used herein, rendering of a musical performance includes synthesis (using a digital acoustic model of the musical instrument) of tones, overtones, amplitudes, perturbations and performance nuances based on the captured (and, in some cases, transmitted) gesture stream. Often, rendering of the performance includes audible rendering by converting to acoustic energy a signal synthesized from the gesture stream encoding (e.g., by driving a speaker). In some cases, audible rendering from a gesture stream encoding is on the very device on which the musical performance is captured. In some cases, the gesture stream encoding is conveyed to a remote device whereupon audible rendering converts a synthesized signal to acoustic energy. Often, both the device on which a performance is captured and that on which the corresponding gesture stream encoding is rendered are portable, even handheld devices, such as mobile phones, personal digital assistants, smart phones, media players, book readers, laptop or notebook computers or netbooks.

In some cases, rendering is to a conventional audio encoding such as AAC, MP3, etc. Typically (though not necessarily), rendering to an audio encoding format is performed on a computational system with substantial processing and storage facilities, such as a server on which appropriate CODECs may operate and from which content may thereafter be served. Often, the same gesture stream encoding of a performance may (i) support local, real-time audible rendering on the capture device, (ii) be transmitted for audible rendering on one or more remote devices that execute a digital synthesis of the musical instrument and/or (iii) be rendering to an audio encoding format to support conventional streaming or download.

In the description that follows, certain computational platforms typical of mobile handheld devices are used in the context of teaching examples. In particular, sensors, capabilities and feature sets, computational facilities, application programmer interfaces (APIs), acoustic transducer and wireless communication capabilities, displays, software delivery and other facilities typical of modern handheld mobile devices are generally presumed. In this regard, the description herein assumes a familiarity with capabilities and features of devices such as iPhone™ handhelds, available from Apple Computer, Inc. However, based on the description herein, persons of ordinary skill in the art will appreciate applications to a wide range of devices and systems, including other portable devices whether or not hand held (or holdable). Indeed, based on the description herein, persons of ordinary skill in the art will immediately appreciate applications and/or adaptations of some embodiments to laptop computers, netbooks and other portable devices.

Likewise, in the description that follows, certain interactive behaviors and use cases consistent with particular types of musical instruments are provided as examples. In some cases, simulations or digitally-synthesized versions of musical instruments may play prominent roles in the interactive behaviors and/or use cases. Indeed as a concrete implementation, and to provide a useful descriptive context, certain synthetic wind instrument embodiments are described herein, including a flute-type wind instrument referred to herein as an "Ocarina" and a trombone-type wind instrument referred to herein as "Leaf Trombone." In both cases, user gestures include blowing into a microphone. For Ocarina, user fingerings of one or more simulated "holes" on a touch screen are additional gestures and are selective for characteristic pitches of the musical instrument. For Leaf Trombone, finger gestures on a touch screen simulate positional extension and retraction of a slide though a range of positions resulting in a generally continuous range of pitches for the trombone within a current octave, while additional finger gestures (again on the touch screen) are simultaneously selective for alternative (e.g., higher and lower) octave ranges. For Ocarina, user movement gestures (as captured from device motion based on an on-board accelerometer) establish vibrato for the performance. For example, in some embodiments, up-down tilt maps to vibrato depth, while left-right tilt maps to vibrato rate.

Of course, the particular instruments, user controls and gestural conventions are purely illustrative. Based on the description herein, persons of ordinary skill in the art will appreciate a wide range of synthetic musical instruments, controls, gestures and encodings that may be supported or employed in alternative embodiments. Accordingly, while particular musical instruments, controls, gestures and encodings provide a useful descriptive context, that context is not intended to limit the scope of the appended claims.

Finally, some of the description herein assumes a basic familiarity with programming environments and, indeed, with programming environments that facilitate the specification, using a high-level audio programming language, of code for real-time synthesis, composition and performance of audio. Indeed, some of the description herein presents functionality as source code from a high-level audio programming language known as ChucK. Programming tools and execution environments for ChucK code include a ChucK compiler and a ChucK virtual machine, implementations of which are available from Princeton University (including executable and source forms published at http://chuck.cs.princeton.edu/). The ChucK language specification and the ChucK Programmer's Reference provide substantial detail and source code. ChucK and ChucK implementations are based on work described in considerable detail in Ge Wang, The ChucK Audio Programming Language: A Strongly-timed and On-the-fly Environ/mentality, PhD Thesis, Princeton University (2008). Of course, while specific instances of functional code defined in accordance with ChucK programming language specifications provides a useful descriptive context, software implementations and indeed programmed devices in accordance with the present invention need not employ ChucK programming tools or execution environments. More specifically, neither ChucK code examples, nor descriptions couched in ChucK-type language constructs or terminology is intended to limit the scope of the appended claims. In view of the foregoing, and without limitation, certain illustrative embodiments are now described.

In view of the foregoing, and without limitation, certain illustrative mobile phone hosted implementations of synthetic wind instruments are described.

Synthetic Wind Instruments and Performances, Generally

Figure 2:
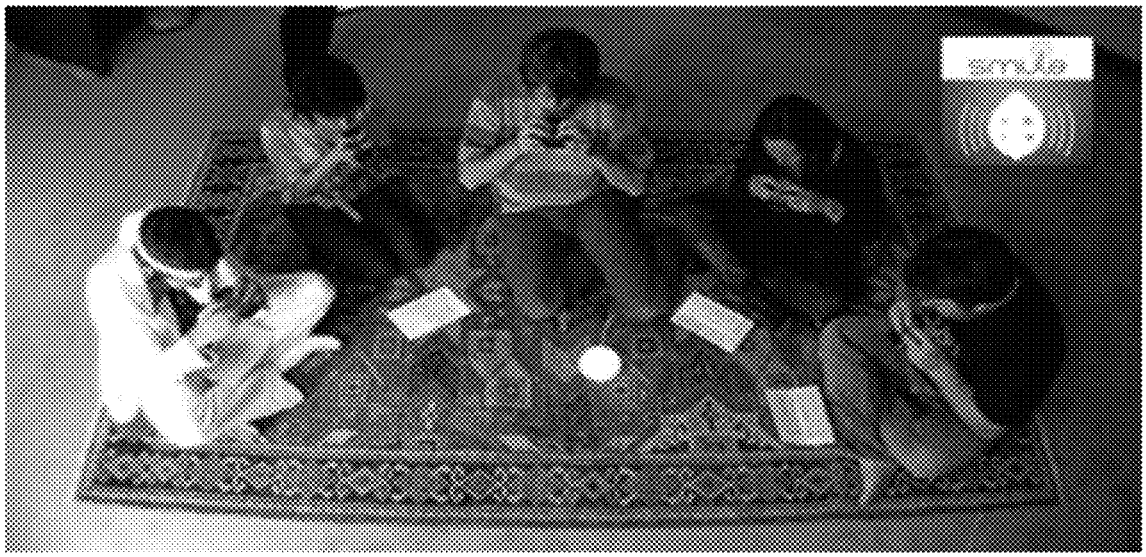

FIGS. 1 and 2 depict performance uses of a portable device hosted implementation of a wind instrument in accordance with some embodiments of the present invention. In particular, the drawings depict use of a Smule Ocarina™ application implementing a synthetic wind instrument designed for the iPhone® mobile digital device. The Smule Ocarina application leverages a wide array of technologies deployed or facilitated on iPhone-type devices including: microphone input (for breath input), multi-touch screen (for fingering), accelerometer, real-time sound synthesis and speaker output, high performance graphics, GPS/location, and persistent wireless data connection. Smule Ocarina is a trademark of SonicMule, Inc. iPhone is a registered trademark of Apple, Inc.

FIG. 1 depicts an individual performance use of the Smule Ocarina application (hereinafter "Ocarina"), while FIG. 2 depicts performances as an ensemble. In this mobile device implementation, interactions of the ancient flute-like instrument are both preserved and transformed via breath-control and multitouch finger-holes, while the onboard global positioning and persistent data connection provide the opportunity to create a new social experience, allowing the users of Ocarina to listen each other's performances. In this way, Ocarina is also a type of social instrument that creates a sense of global connectivity.

Ocarina is sensitive to one's breath (gently blowing into the microphone controls intensity), touch (via a multitouch interface based on the 4-hole English pendant ocarina), and movement (dual axis accelerometer controls vibrato rate and depth). It also extends the traditional physical acoustic instrument by providing precise intonation, extended pitch range, and key/mode mappings. As one plays, the finger-holes respond sonically and on-screen, and the breath is visually represented on-screen in pulsing waves. Sound synthesis corresponding to user gestures takes place in real-time on the iPhone via an audio engine deployed using the ChucK programming language and runtime.

Figure 3:
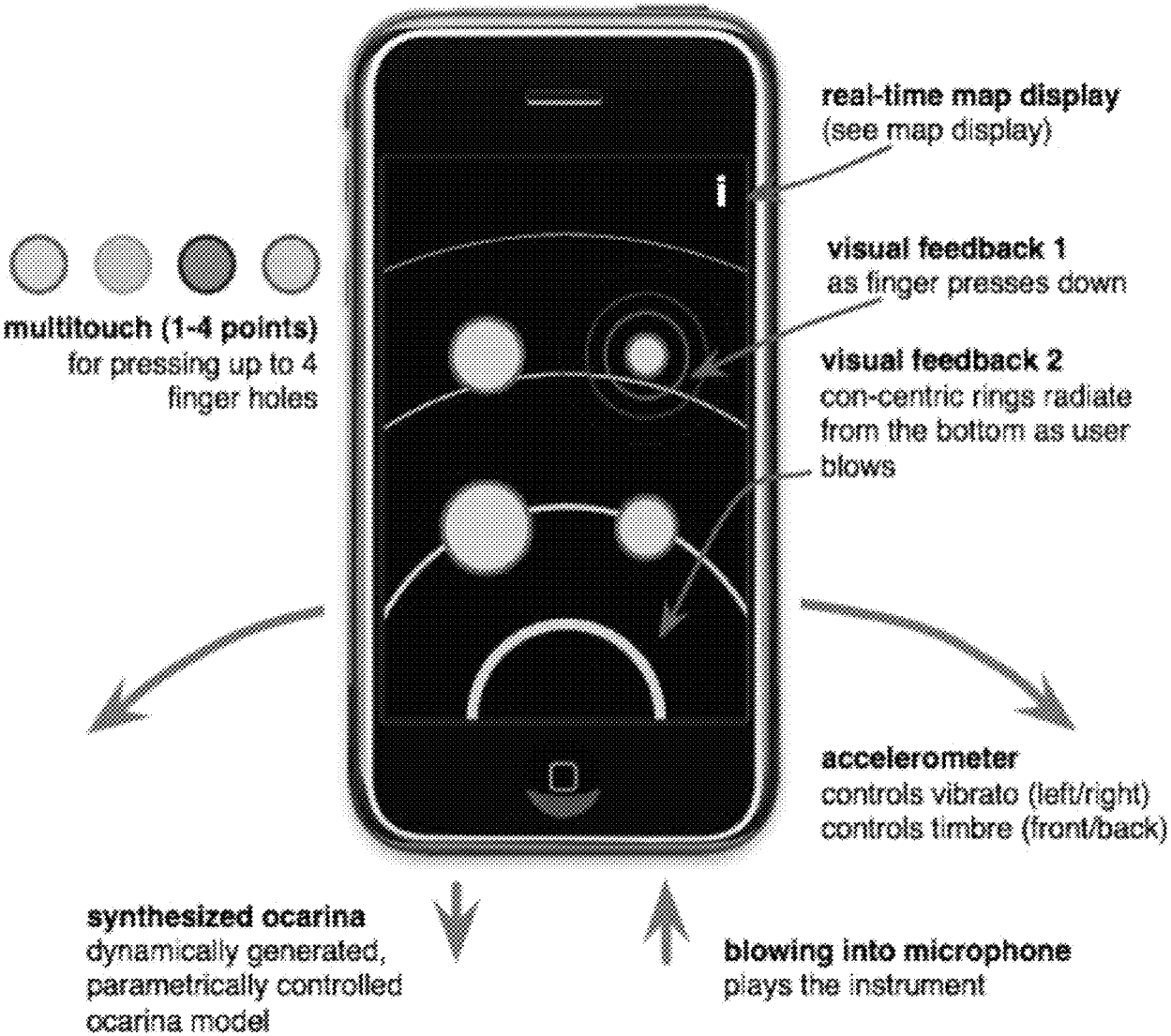
FIG. 3 illustrates certain aspects of a user interface design for a synthetic wind instrument in accordance with some embodiments of the present invention.

FIG. 3 illustrates a user interface design for Ocarina that leverages the onboard microphone for breath input (located on the bottom right of the device). A ChucK shred analyzes the input in real-time via an envelope follower, tracking the amplitude and mapping it to the intensity of the synthesized Ocarina tone. This preserves the physical interaction of blowing from the traditional physical acoustic instrument and provides an analogous form of user control in the synthetic Ocarina. Multitouch is used to allow the player to finger any combination of the four finger holes, giving a total of 16 different combinations. Animated visual feedback reinforces the engaging of the breath input and the multitouch fingering. Sound is synthesized in real-time from user gestures (e.g., captured microphone, touch screen, and accelerometer inputs). The onboard accelerometer is mapped to vibrato. Up-down tilt is mapped to vibrato depth, while the left-right tilt is mapped to vibrato rate. This allows high-level expressive control, and contributes to the visual aspect of the instrument, as it encourages the player to physically move the device.

The acoustic ocarina produces sound as a Helmholtz resonator, and the size of the finger holes are carefully chosen to affect the amount of total uncovered area as a ratio to the enclosed volume and thickness of the ocarina—this relationship directly affects the resulting frequency. The pitch range of a 4-hole English pendant ocarina is typically one octave, the lowest note played by covering all four finger holes, and the highest played by uncovering all finger holes. Some chromatic pitches are played by partially covering certain holes. Since the Smule Ocarina is digitally synthesized, a certain amount of flexibility becomes available. No longer coupled to the physical parameters, the digital Ocarina offers precise intonation for all pitches, and is able to remap and extend the fingering. For example, the Smule Ocarina allows the player to choose the root key and mode (e.g., Ionian, Dorian, Phrygian, etc.), the latter offering alternate mappings to the fingering.

While innovative, the above-described interface is only part of the instrument. Ocarina is also a unique social artifact, allowing its user to hear other Ocarina players throughout the world while seeing their location—achieved through GPS and the persistent data connection on the iPhone. The instrument captures salient gestural information that can be compactly transmitted, stored, and precisely rendered into sound in another instrument's World Listener, presenting a different way to play and share music.

Figure 4:
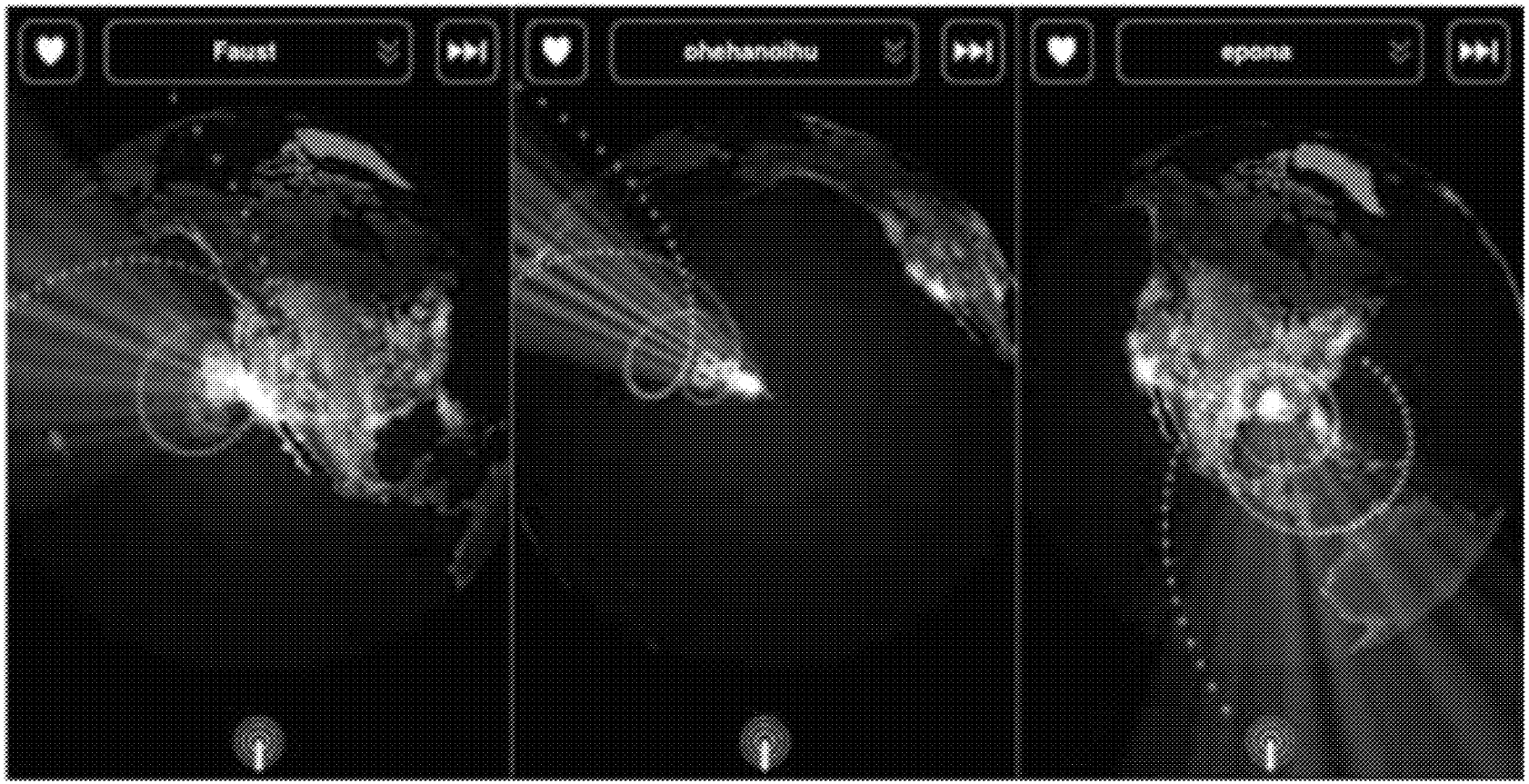
FIG. 4 illustrates performance rendering aspects of a user interface design for a musical synthesis application in accordance with some embodiments of the present invention.

FIG. 4 illustrates the Smule Ocarina's World Listener view, where one can see the locations of other Ocarina instruments (as indicated by white points of light), and listen to received performances of other remote users. If the listener likes a particular performance received and rendered in the World Listener, he can "love" the performance by tapping the heart icon. In some implementations, the particular performances received at a given Ocarina for audible rendering are chosen at a central server, taking into account recentness, popularity, geographic diversity of the snippets, as well as filter selections by the user.

In general, the listener can also choose to listen to performances sourced from throughout world, from a specific region, those that he has loved, and/or those he himself has performed. The performances are captured on the device as the instrument is played. In particular, gesture streams are captured, encoded and tagged with the current GPS location (given the user has granted access), then sent as a wireless data transmission to the server. As a result, the encoded musical performance includes precisely timed gestural information (e.g., breath pressure, finger-hole state, tilt) that is both compact and rich in expressive content. During playback, the Ocarina audio engine interprets and audibly renders the gestural information as sound in real-time. ChucK's strongly-timed features lend themselves naturally to the implementation of rendering engines that model acoustics of the synthesized musical instrument.

Gesture Stream Capture and Encoding

Figure 5:
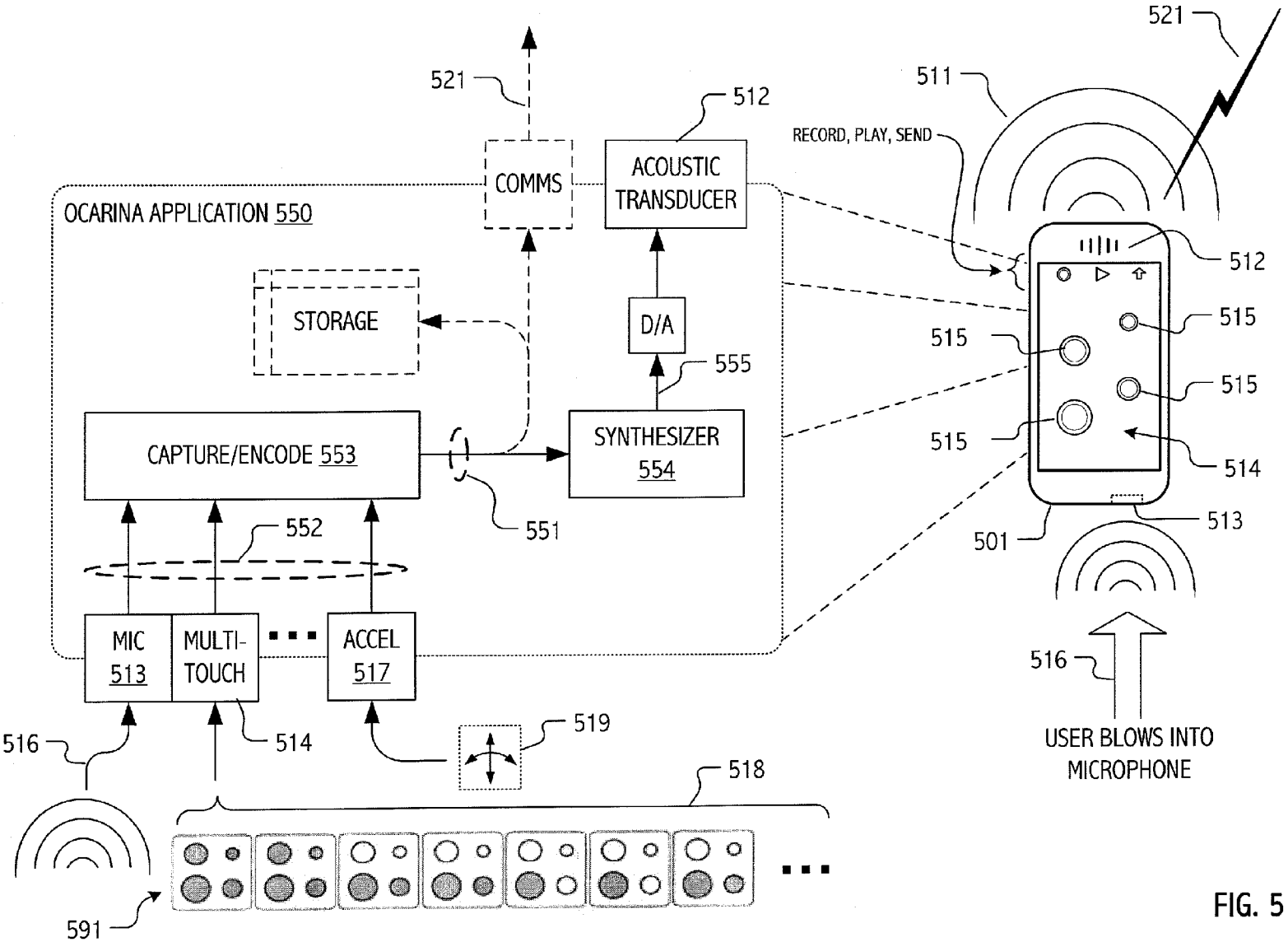
FIG. 5 is a functional block diagram that illustrates capture and encoding of user gestures corresponding to the first several bars of a performance on a synthetic wind instrument and acoustic rendering of the performance in accordance with some embodiments of the present invention.

FIG. 5 is a functional block diagram that illustrates capture and encoding of user gestures corresponding to the first several bars of a performance 681 of the familiar melody, Twinkle Twinkle Little Star, on a synthetic wind instrument, here the Smule Ocarina application 550 executing on an iPhone mobile digital device 501. FIG. 5 also illustrates audible rendering of the captured performance. As previously described, user controls for the synthetic Ocarina are captured from a plurality of sensor inputs including microphone 513, multi-touch display 514 and accelerometer 518. User gestures captured from the sensor inputs are used to parametrically encode the user's performance. In particular, breath (or blowing) gestures 516 are sensed at microphone 513, fingering gestures 518 are sensed using facilities and interfaces of multi-touch display 514, and movement gestures 519 are sensed using accelerometer 518.

Notwithstanding the illustration of a fingering sequence in accord with generally uniform tablature 591, persons of ordinary skill in the art will recognize that actual fingering gestures 518 at holes 515, indeed each of the gestures sequences 552 captured and encoded by Ocarina application 550 (e.g., at 553), will typically include the timing idiosyncrasies, skews, variances and perturbations characteristic of an actual user performance. Thus, even different performances corresponding to the same tablature 591 generally present different gestural information (breath pressure, finger-hole state, tilt) that expresses the unique characteristics of the given performances. Ocarina application 550 captures and encodes (553) those unique performance characteristics as an encoded gesture stream 551 and, in the illustrated embodiment, uses the gesture stream to synthesize a signal 555 that is transduced to audible sound 511 at acoustic transducer (or speaker) 512. In the illustrated embodiment, synthesizer 554 includes a model of the acoustic response of the aforementioned synthetic Ocarina.

The result is a local, real-time audible rendering of the performance captured from breath, fingering and movement gestures of the user. More generally, the illustrated embodiment provides facilities to capture, parameterize, transmit, filter, etc. musical performance gestures in ways that may be particularly useful for mobile digital devices (e.g., cell phones, personal digital, assistants, etc.). In some embodiments, Ocarina application 550 efficiently captures performance gestures, processes them locally using computational resources of the illustrated iPhone mobile digital device 501 (e.g., by coding, compressing, removing redundancy, formatting, etc.), then wirelessly transmits (521) the encoded gesture stream (or parametric score) to a server (not specifically shown). From such a server, the encoded gesture stream for a performance captured on a first mobile device may be optionally cataloged or indexed and transmitted onward to other mobile devices (as a parametric score) for audible re-rendering on remote mobile devices that likewise host a model of the acoustic response of the synthetic Ocarina, all the while preserving the timing and musical integrity of the original performance.

Figure 6:
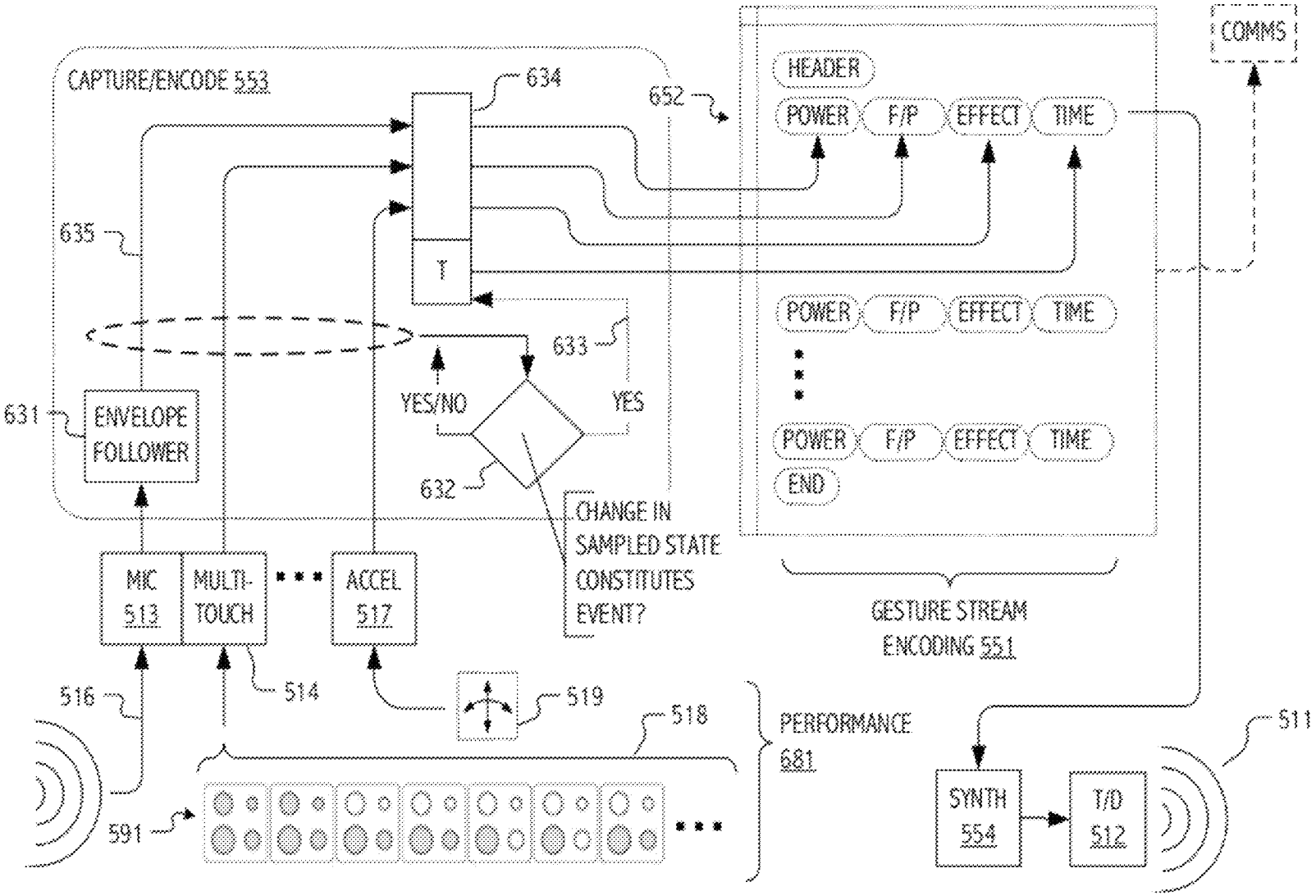
FIG. 6 is a functional block diagram that further illustrates capture and encoding of user gestures together with use of a gesture stream encoding in accordance with some embodiments of the present invention.

FIG. 6 is a functional block diagram that illustrates capture and encoding of user gestures in some implementations of the previously described Ocarina application. Thus, operation of capture/encode block 553 will be understood in the larger context and use scenario introduced above for Ocarina application 550 (recall FIG. 5). As before, breath (or blowing) gestures 516 are sensed at microphone 513, fingering gestures 518 are sensed using facilities and interfaces of multi-touch display 514, and movement gestures 519 are sensed using accelerometer 518. Upon detection of a gesturally significant user interface event, block 553 captures and encodes parameters from microphone 513, from multi-touch display 514 and from accelerometer 518 for inclusion in encoded gesture stream 551. Encoded gesture stream 551 is input to the acoustic model of synthesizer 554 and a corresponding output signal drives acoustic transducer 512, resulting in the audible rendering of the performance as sound 511. As before, encoded gesture stream 551 may be also transmitted to a remote device for rendering.

Changes in sampled states are checked (at 632) to identify events of significance for capture. For example, while successive samples from multi-touch display 514 may be indicative of a change in user controls expressed using the touch screen, most successive samples will exhibit only slight differences that are insignificant from the perspective of fingering state. Indeed, most successive samples (even with slight differences in positional registration) will be indicative of a maintained fingering state at holes 515 (recall FIG. 5). Likewise, samples from microphone 513 and accelerometer 518 may exhibit perturbations that fall below the threshold of a significant user interface event. In general, appropriate thresholds may be gesture, sensor, device and/or implementation specific and any of a variety of filtering or change detection techniques may be employed to discriminate between significant events and extraneous noise. In the illustration of FIG. 6, only those changes that rise to the level of a significant user interface event trigger (632) capture of breath (or blowing) gestures 516, fingering gestures 518 and movement gestures 519.

As described herein, capture of user gestures ultimately drives an acoustic model of the synthetic instrument. In some embodiments, control points are supplied to the acoustic model every T (typically 16 ms in the illustrated embodiment). Accordingly, in such embodiments, checks (e.g., at 632) for significant user interface events need only be performed every T. Likewise, capture of performance gestures (at 634) for inclusion in gesture stream encoding 551, need only be considered every T. As a practical matter the interval between a given pair of successively frames in gesture stream encoding 551 may be significantly longer than T.

This approach presents a significant advantage in both CPU usage and compression. There is a CPU usage gain because the presence of an event in need of recording only has to be determined once per T. If data were recorded more often than T, it would be useless since the control logic only applies these values every T. There is also a compression advantage because the minimum time per recording event is fixed to some duration greater than the sampling period. Indeed, time between successive recorded events may often be substantially greater than T. Recording a control point every T (or less frequently in the absence of gesturally significant user interface events) introduces no loss of fidelity in the recorded performance, as the original performance interpolates between control points every T as well. The main limitation is that T should be short enough for "fast" musical gestures to be representable. In general, 20 ms is a reasonable upper-bound in music/audio systems and is sufficiently small for most scenarios. In some embodiments, selection of T also corresponds with the duration of a single buffer of audio data, i.e., 16 ms on the iPhone. In general, parameters for which lower temporal resolution is acceptable (such a vibrato) may be checked less frequently, e.g., every 2 buffers (or 32 ms). On a CPU-bound system like the iPhone, there can be a significant performance advantage to ensuring that the number of audio buffers per recording event is integral.

An envelope follower 631 is used to condition input data sampled at 16 kHz from microphone 513. In some embodiments, implementation of envelope follower 631 includes a low pass filter. A power measure corresponding to output of the low pass filter quantized for possible inclusion in the gesture stream encoding. In some embodiments, envelope follower 631 is implemented as a one-pole digital filter with a pole at 0.995 whose output is squared.

Exemplary ChucK source code that follows provides an illustrative implementation of envelope follower 631 that filters a microphone input signal sampled by an analog-to-digital converter (adc) and stores a control amplitude (in the pow variable) every 512 samples (or 32 ms at the 16 kHz sampling rate).

```
adc => OnePole power => blackhole;      // suck mic sample through filter
adc => power;                           // connect twice to same source
0.995 => power.pole;   // low-pass slew time
3 => power.op;   // instruct filter to multiply sources
while( true )   {
   power.last( ) => float pow;   // temporary variable
   if( pow < .000002 ) .000002 => pow;   // set power floor
   <<< pow >>>;   // print power so we can see it
   512::samp => now;   // read every so often (gesture rate)
}
```

sIn the illustrated configuration, output 635 of the envelope follower is recorded for each gesturally significant user interface event and introduced into a corresponding event frame (e.g., frame 652) of gesture stream encoding 551 along with fingering (or pitch) information corresponding to the sampled fingering state and vibrato control input corresponding to the sampled accelerometer state.

In some embodiments, gesture stream encoding 551 is represented as a sequence of event frames (such as frame 652) that include a quantized power measure (POWER) from envelope follower 631 for breath (or blowing) gestures, a captured fingering/pitch coding (F/P), a captured accelerometer coding (EFFECT) and a coding of event duration (TIME). For a typical performance, 100s or 1000s of event frames may be sufficient to code the entire performance. In some embodiments, event duration TIME is coded as an 8- or 16-bit integer timestamp (measured in samples at 16 kHz). Timestamps are used to improve compression as data is only recorded during activity, with the timestamp representing time elapsed between gesturally significant user interface events.

Generally, pitch can be determined by using a scale and root note pre-selected by the user, and then mapping each possible Ocarina fingering to an index into that scale. In some cases, a particular fingering may specify whether that particular scale degree needs to be shifted to a different octave. The root and scale information is fixed for a given performance and saved in header information (HEADER), which typically encodes a root pitch, musical mode information, duration and other general parameters for the performance. Thus, in a simple implementation, it may only be necessary to save the fingering (16 possibilities) in each recording event, and not the pitch. In some embodiments, a 32-bit coding encapsulates an 8-bit quantization of breath power (POWER), accelerometer data (EFFECT) and the 16 possible captured fingering states. In some embodiments, a corresponding pitch may be encoded (e.g., using MIDI codes) in lieu of fingering state.

In some embodiments, recorded control data (e.g., gesture stream encoding 551) are fed through the same paths and conditioning as real-time control data, to allow for minimal loss of fidelity. In some embodiments, real-time and recorded control data are effectively the same. Output of the envelope follower, whether directly passed to synthesizer 554 or retrieved from gesture stream encoding 551 is further conditioned before being applied as the envelope of the synthesized instrument. In some embodiments, this additional conditioning consists of a one-pole filter with the pole at 0.995, which provides a smooth envelope, even if the input to this system is quantized in time. In this way, controller logic of synthesizer 554 can supply control points to the instrument envelope every T (16 ms), and the envelope logic will interpolate these control points such that the audible envelope is smooth.

Remote Audible Rendering Using Received Gesture Stream Encoding

Figure 7:
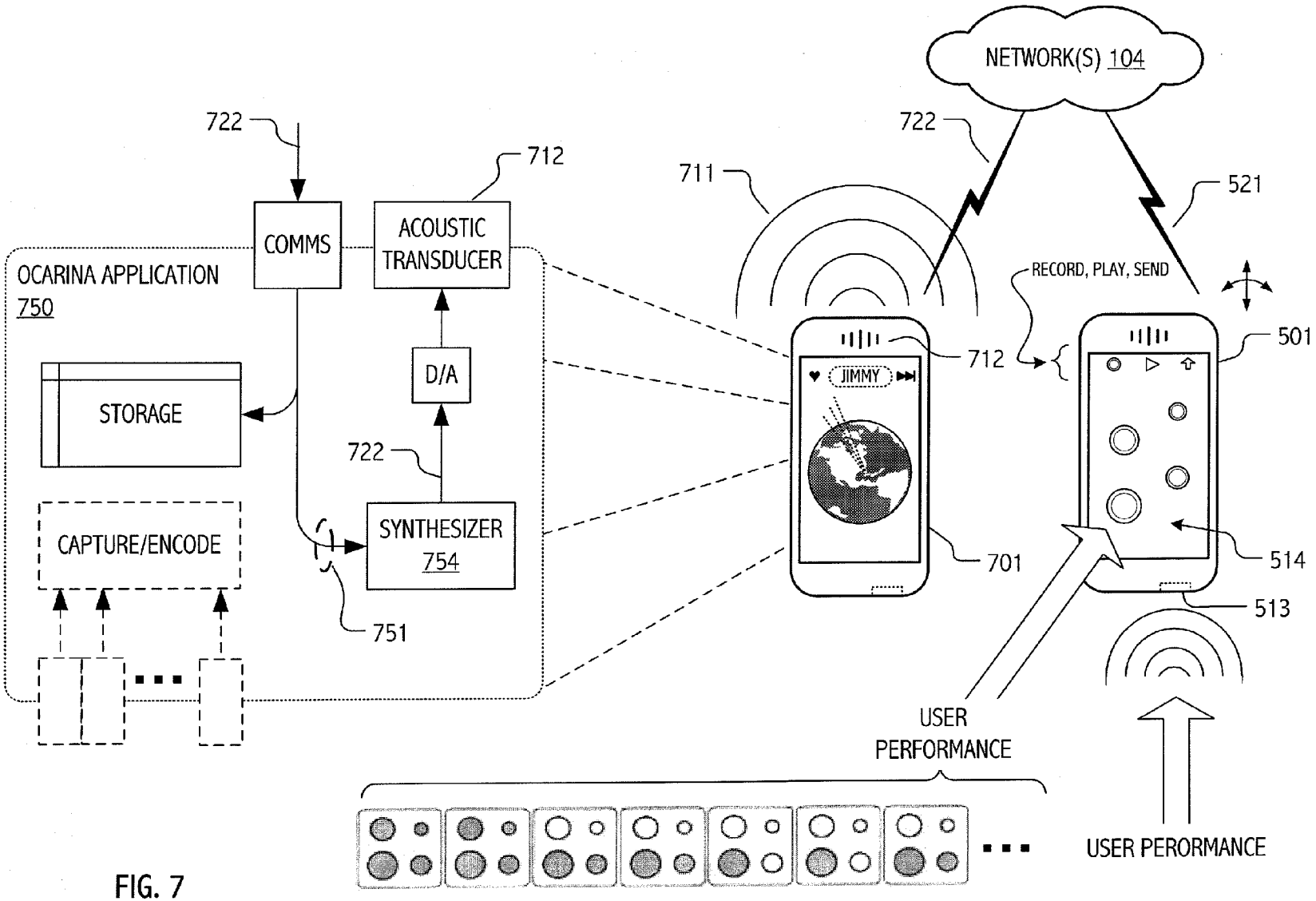
FIG. 7 is a functional block diagram that illustrates capture, encoding and transmission of a gesture stream encoding corresponding to a user performance on a synthetic wind instrument together with receipt of the gesture stream encoding and acoustic rendering of the performance on a remote device.

FIG. 7 is a functional block diagram that illustrates capture, encoding and transmission of a gesture stream encoding corresponding to a user performance on an Ocarina application hosted on a first mobile device 501 (such as that previously described) together with receipt of the gesture stream encoding and acoustic rendering of the performance on second mobile device 701 that hosts a second instance 750 of the Ocarina application. As before, user gestures captured from sensor inputs at device 501 are used to parametrically encode the user's performance. As before, breath (or blowing) gestures are sensed at microphone 513, fingering gestures are sensed using facilities and interfaces of multi-touch display 514, and movement gestures are sensed using an accelerometer. Ocarina application 750 captures and encodes those unique performance characteristics as an encoded gesture stream, then wirelessly transmits (521) the encoded gesture stream (or parametric score) toward a networked server (not specifically shown). From such a server, the encoded gesture stream is transmitted (722) onward to device 701 for audible rendering using Ocarina application 750, which likewise includes a model of the acoustic response of the synthetic Ocarina.

Ocarina application 750 audibly renders the performance captured at device 501 using the received gesture stream encoding 751 as an input to synthesizer 754. An output signal 755 is transduced to audible sound 711 at acoustic transducer (or speaker) 712 of device 701. As before, synthesizer 754 includes a model of the acoustic response of the synthetic Ocarina. The result is a remote audible rendering (at device 701) of the performance captured from breath, fingering and movement gestures of the user (at device 501), all the while preserving the timing and musical integrity of the performance.

Exemplary ChucK source code that follows provides an illustrative implementation of a main gesture stream loop for synthesizer 754. The illustrated loop processes information from frames of received gesture stream encoding 751 including parameterizations of captured breath gestures (conditioned from a microphone input of the performance capturing device), of captured fingering (from a touch screen input stream of the performance capturing device) and of captured movement gestures (from accelerometer of the performance capturing device).

```
// This loop does the breath, fingering, and accelerometers
// Also does the mode (scale) and root (beginning scale note)
// These are (read, conditioned, and maintained by Portal object
// snapshot is the coded stream record/transmit object
while( true )   {
  power.last( ) => float pow;   // measure mic blowing power
  if( pow < .000002 ) .000002 => pow;   // don't let it drop too low
  pow => v_breath;
  pow => ocarina.updateBreath;
  Portal.vibratoRate( ) => v_accelX => ocarina.setVibratoRate;
  Portal.vibratoDepth( ) => v_accelY => ocarina.setVibratoDepth;
  Portal.mode( ) => v_mode => ocarina.setMode;
  Portal.root( ) => v_root => ocarina.setRoot;
  if( v_breath > .0001)   // only code/store if blowing
    vcr.snapshot( now, v_state, v_accelX, v_accelY, v_breath );
  Portal.fingerState( ) => curr;
  if( curr != state )   {   // only do this on fingering changes
    ocarina.setState( curr );
    curr => state => v_state;
    vcr.snapshot( now, v_state, v_accelX, v_accelY, v_breath );
    // this goes into our recorded stream
  }
  16::ms => now;   // check fairly often, but only send if change
}
```

In some embodiments, a similar loop may be employed for real-time audible rendering on the capture device (e.g., as synthesizer 554, recall FIG. 5).

Figure 9:
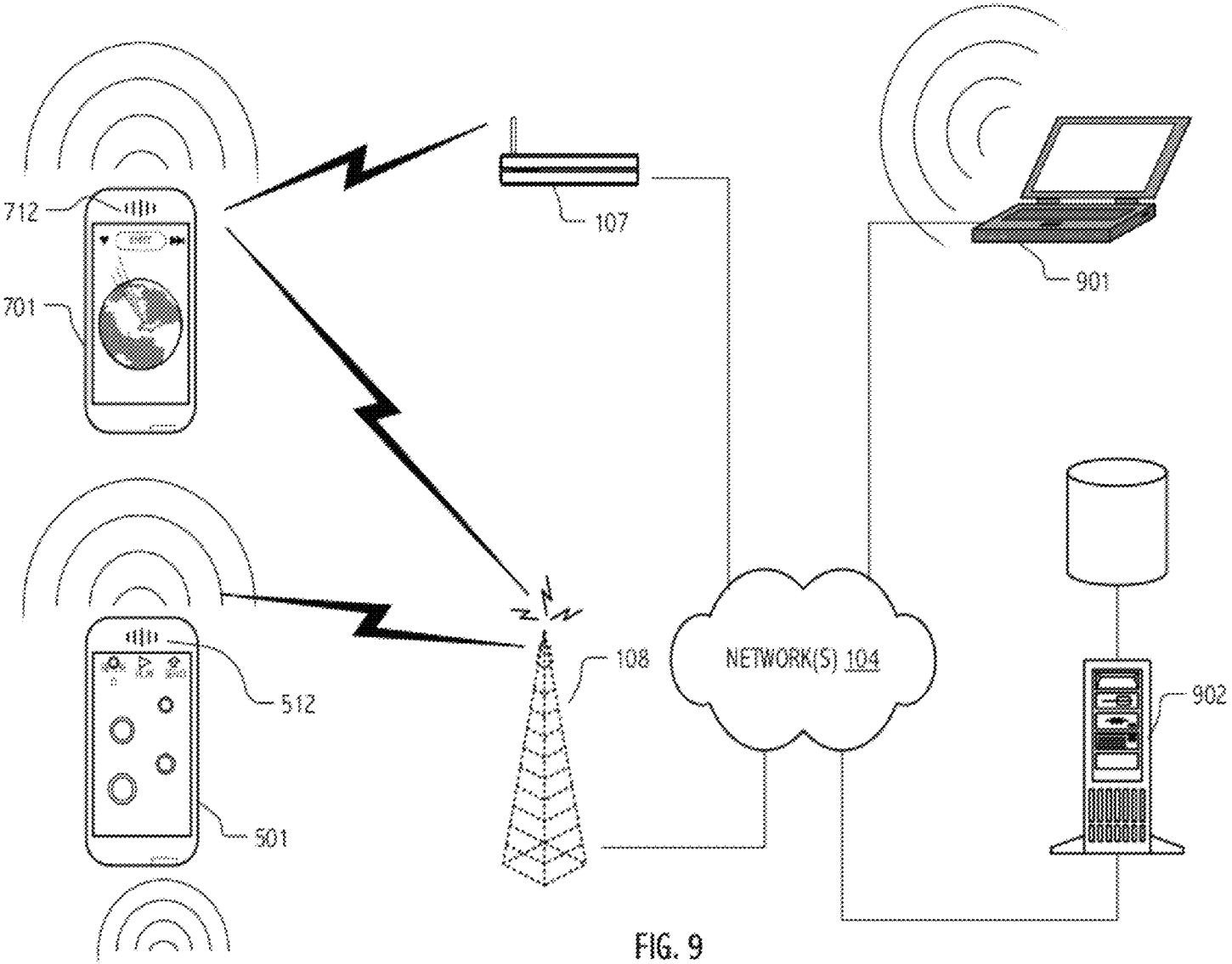
FIG. 9 is a network diagram that illustrates cooperation of exemplary devices in accordance with some embodiments of the present invention.

Consistent with the foregoing, FIG. 9 is a network diagram that illustrates cooperation of exemplary devices in accordance with some embodiments of the present invention. Mobile devices 501 and 701 each host instances of a synthetic musical instrument application (such as previously described relative to the Smule Ocarina) and are interconnected via one or more network paths or technologies (104, 108, 107). A gesture stream encoding captured at mobile digital device 501 may be audibly rendered locally (i.e., on mobile device 501) using a locally executing model of the acoustic response of the synthetic Ocarina. Likewise, that same gesture stream encoding may be transmitted over the illustrated networks and audibly rendered remotely (e.g., on mobile device 701 or on laptop computer 901) using a model of the acoustic response of the synthetic Ocarina executing on the respective device.

In general, while any of the illustrated devices (including laptop computer 901) may host a complete synthetic musical instrument application, in some instances, acoustic rendering may also be supported with a streamlined deployment that omits or disables the performance capture and encoding facilities described herein. In some cases, such as with respect to server 902, rendering facilities may output audio encodings such as an AAC or MP3 encoding of the captured performance suitable for streaming to media players. In general, mobile digital devices 501 and 701, as well as laptop computer 901, may host such a media player in addition to any other applications described herein.

Variations for Leaf Trombone

Based on the detailed description herein of a synthetic Ocarina, persons of ordinary skill in the art will appreciate adaptations and variations for other synthetic musical instruments. For example, another instrument that has been implemented largely in accord with the present description is the Leaf Trombone™ application which provides a synthetic trombone-type wind instrument. Leaf Trombone is a trademark of SonicMule, Inc. For the Leaf Trombone application (hereinafter "Leaf Trombone"), finger gestures on a touch screen simulate positional extension and retraction of a slide though a range of positions resulting in a generally continuous range of pitches for the trombone within a current octave, while additional finger gestures (again on the touch screen) are selective for higher and lower octaves. Thus, relative to a Leaf Trombone adaptation of FIG. 6, performance gestures captured from the touch screen and encoded in gesture stream encoding 551 may be indicative of coded pitch values, rather than the small finite number of fingering possibilities described with reference to Ocarina.

In some embodiments, 8 evenly spaced markers are presented along the touch screen depiction of the virtual slider, corresponding to the 7 degrees of the traditional Western scale plus an octave above the root note of the scale. Finger gestures indicative of a slider position in between two markers will cause the captured pitch to be a linear interpolation of the nearest markers on each side. A root and/or scale may be user selectable in some embodiments or modes.

As with Ocarina, to increase compression, performance data is generally recorded only when a change occurs that can be represented in the recorded data stream. However unlike Ocarina, pitch in Leaf Trombone is represented as a quantization of an otherwise continuous value. In some embodiments, an encoding using 8-bit MIDI note numbers and 8-bit fractional amounts thereof (and 8.8 encoding) may be employed. For Leaf Trombone, changes of a value smaller than 1/256 are ignored if the recording format uses 8 bits to store fractional pitch.

An Exemplary Mobile Device

Figure 8:
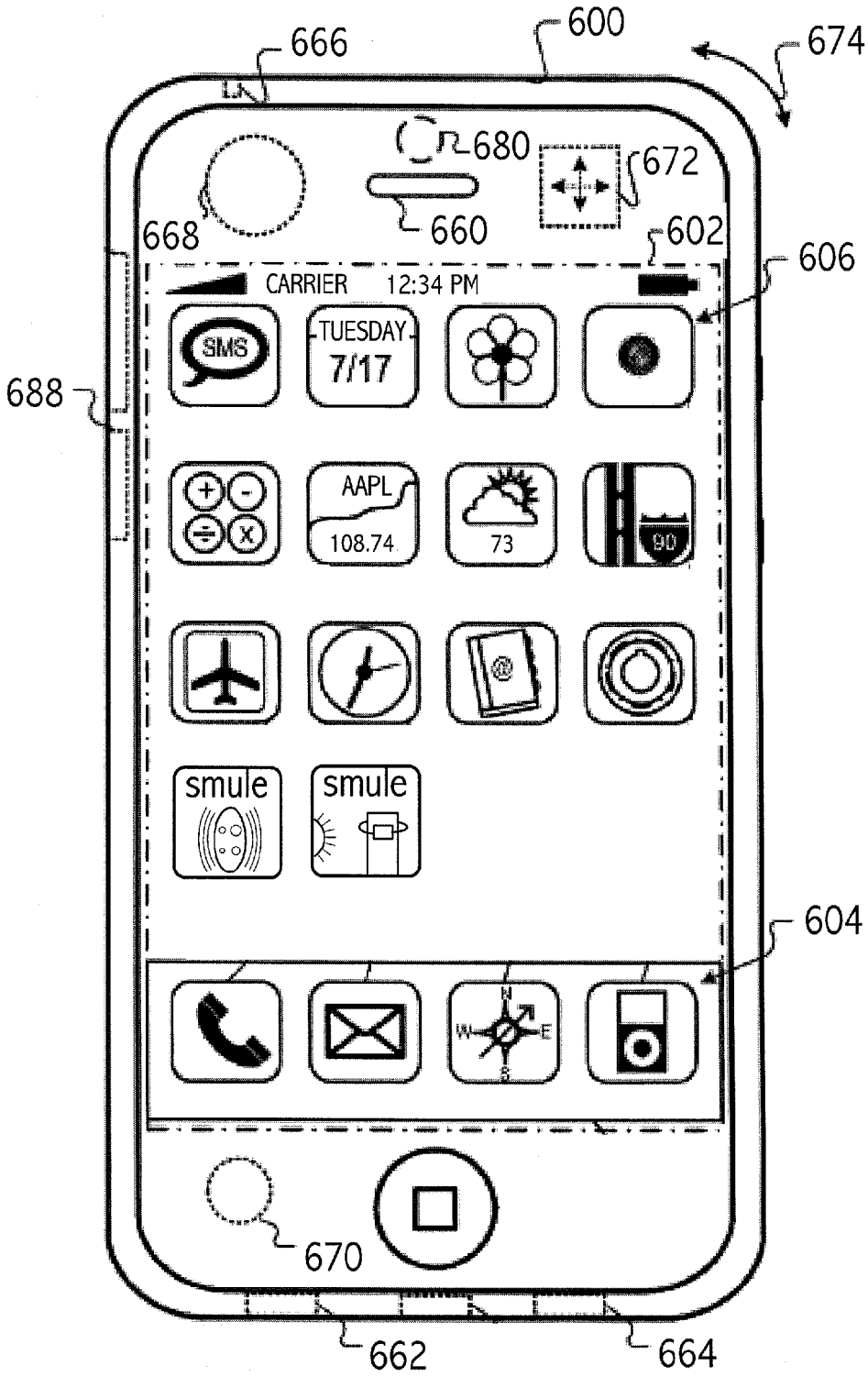
FIG. 8 illustrates features of a mobile device that may serve as a platform for execution of software implementations in accordance with some embodiments of the present invention.

FIG. 8 illustrates features of a mobile device that may serve as a platform for execution of software implementations in accordance with some embodiments of the present invention. More specifically, FIG. 8 is a block diagram of a mobile device 600 that is generally consistent with commercially-available versions of an iPhone™ mobile digital device. Although embodiments of the present invention are certainly not limited to iPhone deployments or applications (or even to iPhone-type devices), the iPhone device, together with its rich complement of sensors, multimedia facilities, application programmer interfaces and wireless application delivery model, provides a highly capable platform on which to deploy certain implementations.

Summarizing briefly, mobile device 600 includes a display 602 that can be sensitive to haptic and/or tactile contact with a user. Touch-sensitive display 602 can support multi-touch features, processing multiple simultaneous touch points, including processing data related to the pressure, degree and/or position of each touch point. Such processing facilitates gestures and interactions with multiple fingers, chording, and other interactions. Of course, other touch-sensitive display technologies can also be used, e.g., a display in which contact is made using a stylus or other pointing device.

Typically, mobile device 600 presents a graphical user interface on the touch-sensitive display 602, providing the user access to various system objects and for conveying information. In some implementations, the graphical user interface can include one or more display objects 604, 606. In the example shown, the display objects 604, 606, are graphic representations of system objects. Examples of system objects include device functions, applications, windows, files, alerts, events, or other identifiable system objects. In some embodiments of the present invention, applications, when executed, provide at least some of the digital acoustic functionality described herein.

Typically, the mobile device 600 supports network connectivity including, for example, both mobile radio and wireless internetworking functionality to enable the user to travel with the mobile device 600 and its associated network-enabled functions. In some cases, the mobile device 600 can interact with other devices in the vicinity (e.g., via Wi-Fi, Bluetooth, etc.). For example, mobile device 600 can be configured to interact with peers or a base station for one or more devices. As such, mobile device 600 may grant or deny network access to other wireless devices. In some embodiments of the present invention, digital acoustic techniques may be employed to facilitate pairing of devices and/or other network-enabled functions.

Mobile device 600 includes a variety of input/output (I/O) devices, sensors and transducers. For example, a speaker 660 and a microphone 662 are typically included to facilitate voice-enabled functionalities, such as phone and voice mail functions. In some embodiments of the present invention, speaker 660 and microphone 662 may provide appropriate transducers for digital acoustic techniques described herein. An external speaker port 664 can be included to facilitate hands-free voice functionalities, such as speaker phone functions. An audio jack 666 can also be included for use of headphones and/or a microphone. In some embodiments, an external speaker or microphone may be used as a transducer for the digital acoustic techniques described herein.

Other sensors can also be used or provided. A proximity sensor 668 can be included to facilitate the detection of user positioning of mobile device 600. In some implementations, an ambient light sensor 670 can be utilized to facilitate adjusting brightness of the touch-sensitive display 602. An accelerometer 672 can be utilized to detect movement of mobile device 600, as indicated by the directional arrow 674. Accordingly, display objects and/or media can be presented according to a detected orientation, e.g., portrait or landscape. In some implementations, mobile device 600 may include circuitry and sensors for supporting a location determining'capability, such as that provided by the global positioning system (GPS) or other positioning systems (e.g., systems using Wi-Fi access points, television signals, cellular grids, Uniform Resource Locators (URLs)). Mobile device 600 can also include a camera lens and sensor 680. In some implementations, the camera lens and sensor 680 can be located on the back surface of the mobile device 600. The camera can capture still images and/or video.

Mobile device 600 can also include one or more wireless communication subsystems, such as an 802.11b/g communication device, and/or a Bluetooth™ communication device 688. Other communication protocols can also be supported, including other 802.x communication protocols (e.g., WiMax, Wi-Fi, 3G), code division multiple access (CDMA), global system for mobile communications (GSM), Enhanced Data GSM Environment (EDGE), etc. A port device 690, e.g., a Universal Serial Bus (USB) port, or a docking port, or some other wired port connection, can be included and used to establish a wired connection to other computing devices, such as other communication devices 600, network access devices, a personal computer, a printer, or other processing devices capable of receiving and/or transmitting data. Port device 690 may also allow mobile device 600 to synchronize with a host device using one or more protocols, such as, for example, the TCP/IP, HTTP, UDP and any other known protocol.

Other Embodiments

While the invention(s) is (are) described with reference to various embodiments, it will be understood that these embodiments are illustrative and that the scope of the invention(s) is not limited to them. Many variations, modifications, additions, and improvements are possible. For example, while particular gesture sets and particular synthetic instruments have been described in detail herein, other variations will be appreciated based on the description herein. Further-more, while certain illustrative signal processing techniques have been described in the context of certain illustrative applications, persons of ordinary skill in the art will recognize that it is straightforward to modify the described techniques to accommodate other suitable signal processing techniques.

In general, plural instances may be provided for components, operations or structures described herein as a single instance. Boundaries between various components, operations and data stores are somewhat arbitrary, and particular operations are illustrated in the context of specific illustrative configurations. Other allocations of functionality are envisioned and may fall within the scope of the invention(s). In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the invention(s).

What is claimed is:

1. A method comprising:

using a portable computing device as a musical instrument, the portable computing device having a multi-sensor user-machine interface, wherein the musical instrument is a synthetic wind instrument and the multi-sensor user-machine interface includes a microphone and a multi-touch sensitive display;

capturing user gestures from data sampled from plural of the multiple sensors, the user gestures indicative of user manipulation of controls of the musical instrument;

encoding a gesture stream for a performance of the user by parameterizing at least a subset of events captured from the plural sensors; and audibly rendering the performance on the portable computing device using the encoded gesture stream as an input to a digital synthesis of the musical instrument executing on the portable computing device.

2. The method of claim 1, wherein the portable computing device includes a communications interface, the method further comprising, transmitting the encoded gesture stream via the communications interface for rendering of the performance on a remote device.

3. A method comprising:

using a portable computing device as a musical instrument, the portable computing device having a multi-sensor user-machine interface;

capturing user gestures from data sampled from plural of the multiple sensors, the user gestures indicative of user manipulation of controls of the musical instrument;

encoding a gesture stream for a performance of the user by parameterizing at least a subset of events captured from the plural sensors; and audibly rendering the performance on the portable computing device using the encoded gesture stream as an input to a digital synthesis of the musical instrument executing on the portable computing device, wherein the encoded gesture stream effectively compresses the sampled data by substantially eliminating duplicative states maintained across multiple samples of user manipulation state and instead coding performance time elapsed between events of the parameterized subset.

4. The method of claim 3, wherein the elapsed performance time is coded at least in part using event timestamps.

5. The method of claim 1, wherein relative to the microphone, the capturing includes recognizing sampled data indicative of the user blowing on the microphone.

6. The method of claim 5, wherein the recognition of sampled data indicative of the user blowing on the microphone includes conditioning input data sampled from the microphone using an envelope follower; and wherein the gesture stream encoding includes recording output of the envelope follower at each parameterized event.

7. The method of claim 6, wherein implementation of envelope follower includes a low pass filter and a power measure corresponding to output of the low pass filter quantized for the inclusion in the gesture stream encoding.

8. The method of claim 7, wherein the audible rendering includes further conditioning output of the envelope follower to temporally smooth a T-sampled envelope for the digitally synthesized musical instrument, wherein T is substantially smaller than elapsed time between the events captured and parameterized in the encoded gesture stream.

9. The method of claim 8, wherein an 8-bit timestamp is used to encode elapsed performance time between events of up to about 4 seconds; and wherein T=16 milliseconds.

10. The method of claim 1, wherein relative to the multi-touch sensitive display, the capturing includes recognizing at least transient presence of one or more fingers at respective display positions corresponding to a hole or valve of the synthetic wind instrument; and wherein at least some of the parameterized events encode respective pitch in correspondence with the recognized presence of one or more fingers.

11. The method of claim 1, wherein relative to the multi-touch sensitive display, the capturing includes recognizing at least transient presence of a finger along a range of positions corresponding to slide position of the synthetic wind instrument; and wherein at least some of the parameterized events encode respective pitch interpolated in correspondence with recognized position.

12. The method of claim 1, wherein the multi-sensor user-machine interface further includes an accelerometer, wherein relative to the accelerometer, the capturing includes recognizing movement-type ones of the user gestures, and wherein the movement-type user gestures captured using the accelerometer are indicative of one or more of vibrato and timbre for the rendered performance.

13. The method of claim 1, wherein the digital synthesis includes a model of acoustic response for one of:

a flute-type wind instrument; and a trombone-type wind instrument.

14. The method of claim 2, further comprising:

rendering the performance on the remote device using the encoded gesture stream as an input to a second digital synthesis of the musical instrument on the remote device.

15. The method of claim 14, wherein the remote device and the portable computing device are both selected from the group of:

a mobile phone;

a personal digital assistant; and a laptop computer, notebook computer or netbook.

16. The method of claim 14, wherein the remote device includes a server from which the rendered performance is subsequently supplied as one or more audio encodings thereof.

17. The method of claim 2, further comprising:

audibly rendering a second performance on the portable computing device using a second gesture stream encoding received via the communications interface directly or indirectly from a second remote device, the second performance rendering using the received second gesture stream encoding as an input to the digital synthesis of the musical instrument.

18. A method comprising:

using a portable computing device as a musical instrument, the portable computing device having a multi-sensor user-machine interface and a communications interface;

capturing user gestures from data sampled from plural of the multiple sensors, the user gestures indicative of user manipulation of controls of the musical instrument;

encoding a gesture stream for a performance of the user by parameterizing at least a subset of events captured from the plural sensors;

audibly rendering the performance on the portable computing device using the encoded gesture stream as an input to a digital synthesis of the musical instrument executing on the portable computing device;

geocoding and transmitting the encoded gesture stream via the communications interface for rendering of the performance on a remote device; and displaying a geographic origin for, and in correspondence with audible rendering of, a third performance encoded as a third gesture stream received via the communications interface directly or indirectly from a third remote device.

19. A computer program product encoded in one or more non-transitory media, the computer program product including instructions executable on a processor of the portable computing device to cause the portable computing device to perform the method of claim 1.

20. The computer program product of claim 19, wherein the one or more non-transitory media are readable by the portable computing device or readable incident to a computer program product conveying transmission to the portable computing device.

21. A method of using a portable computing device as a musical instrument, the portable computing device having a multi-sensor user-machine interface, the method comprising:

capturing user gestures from data sampled from the sensors, the user gestures indicative of user manipulation of controls of the musical instrument;

encoding a gesture stream for a performance of the user by parameterizing at least a subset of events captured from the plural sensors; and transmitting the encoded gesture stream via a communications interface for rendering of the performance on a remote device using the encoded gesture stream as an input to a digital synthesis of the musical instrument hosted thereon, wherein the encoded gesture stream effectively compresses the sampled data by substantially eliminating duplicative states maintained across multiple samples of user manipulation state and instead coding performance time elapsed between events of the parameterized subset.

22. The method of claim 21, further comprising:

audibly rendering the performance on the portable computing device using the encoded gesture stream as an input to a local digital synthesis of the musical instrument.

23. A method of using a portable computing device as a musical instrument, the portable computing device having a multi-sensor user-machine interface, the method comprising:

capturing user gestures from data sampled from the sensors, the user gestures indicative of user manipulation of controls of the musical instrument, wherein the musical instrument is a synthetic wind instrument and wherein the multi-sensor user-machine interface includes a microphone and a multi-touch sensitive display encoding a gesture stream for a performance of the user by parameterizing at least a subset of events captured from the plural sensors; and transmitting the encoded gesture stream via a communications interface for rendering of the performance on a remote device using the encoded gesture stream as an input to a digital synthesis of the musical instrument hosted thereon.

24. The method of claim 23, wherein relative to the microphone, the capturing includes recognizing sampled data indicative of the user blowing on the microphone.

25. The method of claim 24, wherein the recognition of sampled data indicative of the user blowing on the microphone includes conditioning input data sampled from the microphone using an envelope follower; and wherein the gesture stream encoding includes recording output of the envelope follower at each parameterized event.

26. The method of claim 23, wherein relative to the multi-touch sensitive display, the capturing includes recognizing at least transient presence of one or more fingers at respective display positions corresponding to a hole or valve of the synthetic wind instrument; and wherein at least some of the parameterized events encode respective pitch in correspondence with the recognized presence of one or more fingers.

27. The method of claim 23, wherein relative to the multi-touch sensitive display, the capturing includes recognizing at least transient presence of a finger along a range of positions corresponding to slide position of the synthetic wind instrument; and wherein at least some of the parameterized events encode respective pitch interpolated in correspondence with recognized position.

28. The method of claim 23, wherein the multi-sensor user-machine interface further includes an accelerometer, wherein relative to the accelerometer, the capturing includes recognizing movement-type ones of the user gestures, and wherein the movement-type user gestures captured using the accelerometer are indicative of one or more of vibrato and timbre for the rendered performance.

29. The method of claim 21, further comprising:

rendering the performance on the remote device using the encoded gesture stream.

30. The method of claim 29, wherein the rendering on the remote device is an audible rendering.

31. The method of claim 29, wherein the rendering on the remote device is to an audio encoding.

32. An apparatus comprising:

a portable computing device having a multi-sensor user-machine interface; and machine readable code executable on the portable computing device to implement the synthetic wind instrument, the machine readable code including instructions executable to capture user gestures from data sampled from plural of the multiple sensors including a microphone and a multi-touch sensitive display, wherein the user gestures are indicative of user manipulation of controls of the wind instrument, and further executable to encode a gesture stream for a performance of the user by parameterizing at least a subset of events captured from the plural sensors, the machine readable code further executable to audibly render the performance on the portable computing device using the encoded gesture stream as an input to a digital synthesis of the musical instrument.

33. The apparatus of claim 32, embodied as one or more of a handheld mobile device, a mobile phone, a laptop or notebook computer, a personal digital assistant, a smart phone, a media player, a netbook, and a book reader.

34. A computer program product encoded in non-transitory media and including instructions executable to implement a synthetic wind instrument on a portable computing device having a multi-sensor user-machine interface, the computer program product encoding and comprising:

instructions executable to capture user gestures from data sampled from plural of the multiple sensors including a microphone and a multi-touch sensitive display, wherein the user gestures are indicative of user manipulation of controls of the wind instrument, and further executable to encode a gesture stream for a performance of the user by parameterizing at least a subset of events captured from the plural sensors, further instructions executable to audibly render the performance on the portable computing device using the encoded gesture stream as an input to a digital synthesis of the musical instrument.

35. The computer program product of claim 34, further encoding and comprising:

further instructions executable to effectively compresses the sampled data for transmission via a communications interface by substantially eliminating duplicative states maintained across multiple samples of user manipulation state and instead coding performance time elapsed between events of the parameterized subset, the compressed sampled data forming at least a portion of the encoded gesture stream.

36. The computer program product of claim 35, wherein the transmitted gesture stream is geocoded, and further encoding and comprising further instructions executable to display a geographic origin for, and in correspondence with audible rendering of, a third performance encoded as a third gesture stream received via the communications interface directly or indirectly from a third remote device.

37. The apparatus of claim 32, further comprising:

a communications interface suitable for transmitting the encoded gesture stream for rendering of the performance on a remote device, wherein the encoded gesture stream effectively compresses the sampled data by substantially eliminating duplicative states maintained across multiple samples of user manipulation state and instead coding performance time elapsed between events of the parameterized subset.

38. The apparatus of claim 37, wherein the transmitted gesture stream is geocoded, and wherein the machine readable code is further executable to display a geographic origin for, and in correspondence with audible rendering of, a third performance encoded as a third gesture stream received via the communications interface directly or indirectly from a third remote device.

39. The method of claim 1, wherein the encoded gesture stream effectively compresses the sampled data by substantially eliminating duplicative states maintained across multiple samples of user manipulation state and instead coding performance time elapsed between events of the parameterized subset.

40. The method of claim 3, wherein the digital synthesis includes a model of acoustic response for one of:

a flute-type wind instrument; and a trombone-type wind instrument.

41. The method of claim 3, wherein the portable computing device includes a communications interface, the method further comprising, transmitting the encoded gesture stream via the communications interface for rendering of the performance on a remote device.

42. The method of claim 41, further comprising:

rendering the performance on the remote device using the encoded gesture stream as an input to a second digital synthesis of the musical instrument on the remote device.

43. The method of claim 41, further comprising:

audibly rendering a second performance on the portable computing device using a second gesture stream encoding received via the communications interface directly or indirectly from a second remote device, the second performance rendering using the received second gesture stream encoding as an input to the digital synthesis of the musical instrument.

44. The method of claim 41, further comprising:

geocoding the transmitted gesture stream; and displaying a geographic origin for, and in correspondence with audible rendering of, a third performance encoded as a third gesture stream received via the communications interface directly or indirectly from a third remote device.

45. The method of claim 18, further comprising:

rendering the performance on the remote device using the encoded gesture stream as an input to a second digital synthesis of the musical instrument on the remote device.

46. The method of claim 18, further comprising:

audibly rendering a second performance on the portable computing device using a second gesture stream encoding received via the communications interface directly or indirectly from a second remote device, the second performance rendering using the received second gesture stream encoding as an input to the digital synthesis of the musical instrument.

* * * * *